United States Patent [19]

Kaderabek

[11] Patent Number: 4,587,692

[45] Date of Patent: May 13, 1986

[54] UNIVERSAL NAPKIN SUPPORT

[76] Inventor: Milos Kaderabek, Raiffeisenstrasse 14a, 7 Stuttgart 31, Fed. Rep. of Germany

[21] Appl. No.: 627,767

[22] Filed: Jul. 5, 1984

[30] Foreign Application Priority Data

Jul. 5, 1983 [DE] Fed. Rep. of Germany ..... 3324201

[51] Int. Cl.[4] ..... A45F 5/04

[52] U.S. Cl. ..... 24/9; 24/7

[58] Field of Search ..... 24/7, 8, 9, 171, 181, 24/194

[56] References Cited

U.S. PATENT DOCUMENTS

| | | | |
|---|---|---|---|
| 154,543 | 9/1874 | Decker et al. | 24/9 |
| 196,432 | 10/1877 | Chapman | 24/181 |
| 198,065 | 12/1877 | Annin | 24/9 |
| 421,615 | 2/1890 | Riker | 24/9 |
| 546,658 | 9/1895 | Dormitzer | 24/9 |
| 655,069 | 7/1900 | Frame | 24/7 |
| 703,864 | 7/1902 | Walker | 24/9 |
| 868,817 | 10/1907 | Smith | 24/9 |
| 1,253,277 | 1/1918 | Pile | 24/9 |

FOREIGN PATENT DOCUMENTS

| | | | |
|---|---|---|---|
| 59067 | 1/1891 | Fed. Rep. of Germany | 24/9 |

*Primary Examiner*—Victor N. Sakran

*Attorney, Agent, or Firm*—Horst M. Kasper

[57] ABSTRACT

A support provision is disclosed for a napkin, which allows to position the napkin comfortably, secure, flat and aesthetically pleasing at the chest of a person. Two elastic band arms are employed, which are held by two sliding supports such that each sliding support is fixedly attached to a respective band arm and allows the other band arm to slide through the sliding support. A napkin corner is slipped through the space between the two overlapping parts of the band arms between the two siding supports. Extensions can be provided at the sliding supports to allow backfolding of the napkin corner. The rear ends of the band arms can be attached to each other with securing strips to allow a secured position around the neck of the support means for the napkin. Snap fasteners can provide for the attachment of the sliding support to the respective band arm. Dome shaped emblems can be attached to the front of the snap fastener.

8 Claims, 6 Drawing Figures

UNIVERSAL NAPKIN SUPPORT

BACKGROUND OF THE INVENTION

1. Field of the Invention

The present invention relates to a universal napkin support, which is positioned around the neck of a person.

2. Brief Description of the Background of the Invention Including Prior Art

Conventional attachment provisions for napkins at the neck, or at the clothes, in order to prevent soiling with foods or increased flow of saliva, are associated with disadvantages and unpleasant features and do not provide a safe hygienic protection.

Provisions which employ adhesive strips or adhesive surfaces for attaching the napkins to the clothes are known based on the selfadhesive means, which damages the structure of the clothes upon withdrawal of the adhesion surfaces. This kind of attachment is only suitable for childrens clothes, which are washed frequently or which are used only once.

Attachments which support the napkin only with an adhesion closure with adhesive strip at the neck are very cumbersome and frequently a second person is required, which in addition has to be ready with a roll of adhesive strip and scissors. This limits the use to the house and to institutions. Napkins with adhesive closure based on self-adhesive material loose after washing the adhesive strength and have to be connected afterwards with an adhesive strip.

Baby bib napkins have to be secured with knobs, knot bands or adhesive surfaces if they are to provide sufficient protection against soiling, otherwise the branches of the bib napkin have to be knotted while closely contacting the neck, which is considered to be unpleasant by a child and which can lead to defensive actions. The knotting of the branches of a bib napkin is very difficult for sick and handicapped persons, which do not have any longer sufficient capability of handling this on their own and a knot near the neck can be disturbing to a sick person.

Provisions furnished as a bow or as chains with clamps at the ends for attaching rectangular napkins do not result in an adequate protection, since the napkins shift sideways with each movement and it is difficult to maintain the right position for a child. A free intermediate space or large irregular folds can press against the chin because of the non-adjustable length of the bows or chains or based on accidental clamping of the napkin with different distance of the clamps resulting in a concurrent change of the distance of the napkin from the chin.

Furthermore, the most widespread practice of sticking the napkins into the collar or the neck of the clothes does not provide an adequate assurance against soiling. The only loosely inserted napkin slips out after a short time based on movement or standing up and frequently has to be put into place again several times. In addition, an unpleasant feeling, or tickle, can be generated and from an aesthetical point of view this kind of attachment is disadvantageous and unsatisfactory.

A spreading of a napkin on a lap misses the point since soiling of clothes and ties occurs mainly in the upper region of the body from liquid foods and only rarely a bite falls under the table.

SUMMARY OF THE INVENTION

1. Purposes of the Invention

It is an object of the invention to provide a napkin support, which places the napkin over the chest of the user and which does not involve a manipulation of the clothes on the body of the person.

It is another purpose of the invention to provide a napkin support which is aesthetically pleasing and which provides a safe positioning of the napkin.

It is a further purpose of the invention to provide a napkin support which is compact and can be used during travel and which is useful both for children and sick and handicapped persons.

These and other objects and advantages of the present invention will become evident from the description which follows.

2. Brief Description of the Invention

The present invention provides a universal napkin support which comprises two elastic about circular band arms corresponding in their shape about the anatomical rounding of the human neck and having one of their two ends free behind the neck, sliding supports at corresponding one side ends of the band arms and provided with openings for allowing a sliding passage of the other respective band arm passing through and generating a variable interspace between the band arms between the sliding supports for passage of a napkin followed by clamping of the napkin.

Protrusions can be disposed at one side of the inner wall providing horizontal grooves for rendering the sliding motion of the band arms more easy. Extensions of the sliding supports with short arms extend parallel to the band arm toward the neighboring sliding support for allowing to fold back the napkin for producing a doubling of the napkin at the upper end. A snap fastener can match the sliding supports to allow attachment of the band arm to the sliding support and for placing a desired emblem on the napkin support. Cross securing strips can be disposed near the free ends of the band arms.

There is also provided a method for universally supporting a napkin which comprises attaching two sliding supports to one end each of two corresponding about three-quarter circular band arms, where the sliding supports allow the band arm of the other sliding support to slide through an opening, disposing the band arm and holders around the neck of a person, slipping a corner part of a napkin in the area between the two sliding supports through the open space formed by the two band arms.

The upper end of the napkin corner part can be folded behind the band arms and against respective extensions of the sliding supports. Free ends of the band arms can be attached via strips to each other behind the neck of a user. An emblem can be attached to the front side of the sliding supports. The napkin support can be placed into a container suitable for being carried by a traveller.

In accordance with the invention the universal napkin eliminates the disadvantages of conventional supports. The support can be produced for all typical sizes and shapes of napkins and all materials useful for this purpose can be employed. In each case the napkins remain in the same position of the person and provide assured hygienic protection without further auxiliary materials or additional tools. A sideways motion or sliding of the napkin is prevented by the adaptation of the napkin support to the anatomical shape of the neck and it allows to care for the full range of life only by varying the size of the napkin support. In addition, bed-ridden sick and handicapped persons, which have only one hand available, can employ the napkin support easily without help such that in hospitals, nursing homes and institutions the services to the patients can be simplified and time can be saved. The napkin support is very suitable for institutions servicing small children, which prefer to serve themselves, in particular if they are animated by the napkin support with attached exchangeable emblems, which they may have already seen for example on photographs with the parents, with known baseball players, with animals and flowers and the like. The napkin support allows each child to wear its preferred idol around the neck with the napkin and at the same time to protect itself against soiling. The attachment at the neck is absolutely compatible and does not cause any objections and frustrations and the napkin support is considered more like a toy. In case of a grown-up the napkin support meets the aesthetic requirements because of the discreet and unobtrusive appearance. For example, the napkin support is nearly invisible in case a jacket is worn and only the napkin hangs in the front with the desired width over tie and shirt based on the variable compression of the napkin, where because of the insertion of the napkin a double protection is achieved at the location most endangered by liquids. The napkin support also allows a woman to use napkins for the protection of her clothes, garments and jewelry, which had up to now not been accepted based on inhibitions, since a woman in most cases wears open low-necked garments and the sticking of the napkin between garment and bosom could have an unaesthetic and unhygienic aspect. In contrast, the wearing of the napkin support is pleasant and it does not cause an irritation or clamping effect because of the napkin. Based on the small size and the foldability the napkin support can be kept in a small box or case, which can continuously be carried and can be used during lunch and dinner with the provided napkins during travel. The napkin support can be produced of plastic in various colors including golden and silvery such that any need can be fulfilled.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
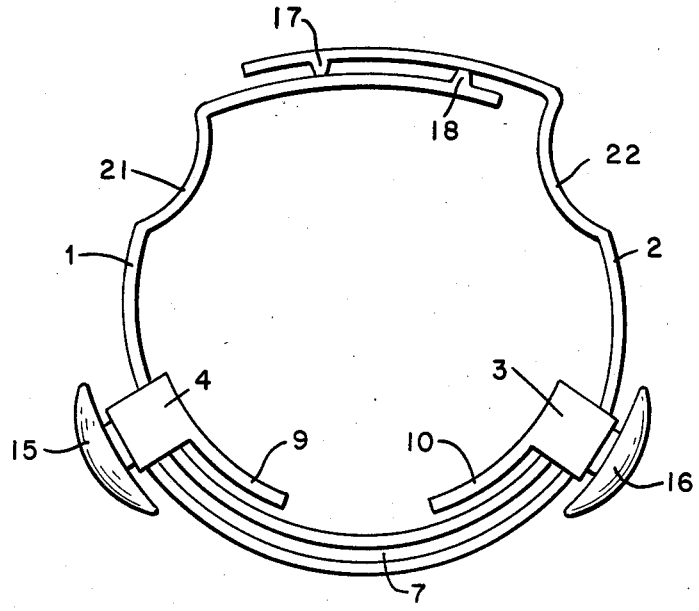
FIG. 1 is a plan view of a schematic representation of the universal napkin support.
Figure 2:
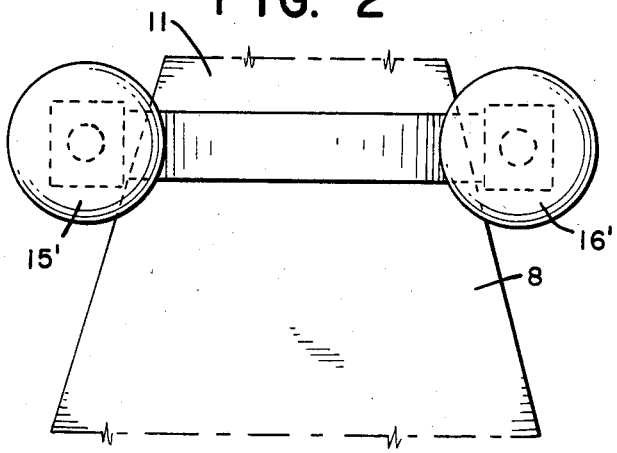
FIG. 2 is a front elevational schematic view of the napkin support.
Figure 3:
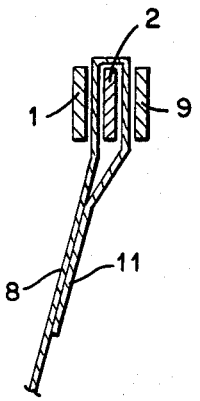
FIG. 3 is a cross-sectional view through the band arms and of the short arm providing the extension of the sliding support.
Figure 4:
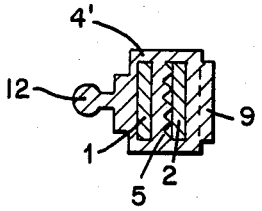
FIG. 4 is a cross-sectional view through the sliding support.
Figure 5:
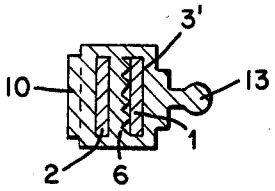
FIG. 5 is a cross-sectional view through the second sliding support.
Figure 6:
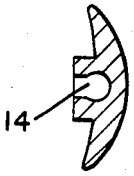
FIG. 6 is a cross-sectional view through an emblem with snap knob attachment.

In accordance with the present invention there is provided a universal napkin support as shown in FIG. 1, which comprises two elastic and relative to the neck of a person circumferential band arms 1, 2. The band arms 1, 2 can be over certain sections about circular or elliptical. Preferably, the form of the band arms 1, 2 corresponds to the anatomical shape of the neck of a person. The anatomical shape of a neck can be matched by two inner bends 21, 22 of the band arms 1, 2. One end of each band arm is attached to a sliding support 3, 4, 3', 4' (compare FIGS. 1, 4, 5). At one side of the inner walls of the sliding supports there are provided protrusions with horizontal grooves 5, 6 (compare FIGS. 4 and 5). The grooves make the passing of the band arms through the sliding supports easier. Based on the height level of the protrusions 9, 10 an appropriate distance of the band arms can be set. A horizontal variable free space 7 between the band arms can be generated by sideways shifting of the sliding supports 3, 4. The napkin 8 can be slid through the variable free space and can be clamped into this space. In order to prevent the napkin 8 from changing its position at to interfere at the neck, the part of the napkin protruding from the band arms 1, 2 is pulled through between the inner band arm 2 and the short arms provided as protruding arms at the inner sides of the sliding supports 3, 4 directed towards the neck. Because of the upper part of the napkin a doubling 11 of the protecting sheets is achieved as illustrated in FIG. 3 and a contact with the neck is prevented by the protruding extensions of the arms 9, 10. Ball shaped extensions 12, 13 (FIGS. 4 and 5) are provided at the outer sides of the sliding supports 3, 4 as inner parts of the snap knob 14 attachment and various emblems 15, 16, 15', 16' can be stuck onto the snap knob attachment (FIGS. 1 and 2). Securing strips 17, 18 running cross to the band arms are disposed at the free ends of the band arms 1, 2. A small box or container can be provided to carry the universal napkin support according to the present invention.

It will be understood that each of the elements described above, or two or more together, may also find a useful application in other types of support system configurations and cloth supporting procedures differing from the types described above.

While the invention has been illustrated and described as embodied in the context of a universal napkin support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A universal napkin support comprising two elastic about circular band arms corresponding in their shape about to the anatomical rounding of the human neck, and having one of their two ends free behind the neck;

sliding supports at corresponding one side ends of the band arms and provided with openings for allowing a sliding passage of the other respective band arm passing through and generating a variable interspace between the band arms between the sliding supports for passage of a napkin followed by clamping of the napkin; and protrusions disposed at one side of the inner wall providing horizontal grooves for rendering the sliding motion of the band arms more easy.

2. The universal napkin support according to claim 1 further comprising extensions of the sliding supports with short arms extending the parallel to the band arm toward the neighboring sliding support for allowing to fold back the napkin for producing a doubling of the napkin at the upper end.

3. The universal napkin support according to claim 1 further comprising a snap fastener matching the sliding supports to allow attachment of the band arm to the sliding support and for placing a desired emblem on the napkin support.

4. The universal napkin support according to claim 1 further comprising cross securing strips disposed near the free ends of the band arms.

5. A method for universally supporting a napkin comprising attaching two sliding supports to one end each of two corresponding about three-quarter circular band arms, where the sliding supports allow the band arm of the other sliding support to slide through an opening;

disposing the band arm and holders around the neck of a person;

slipping a corner part of a napkin in the area between the two sliding supports through the open space formed by the two band arms;

folding the upper end of the napkin corner part behind the band arms and against respective extensions of the sliding supports;

attaching free ends of the band arms via strips to each other behind the neck of a user.

6. The method for universally supporting a napkin according to claim 5 further comprising attaching an emblem to the front side of the sliding supports.

7. The method for universally supporting a napkin according to claim 5 further comprising placing the napkin support into a container suitable for being carried by a traveller.

8. A universal napkin support comprising two elastic about circular band arms corresponding in their shape about to the anatomical rounding of the human neck, including two inward bends corresponding to hollows found on either side of a human spinal column and having one of their two ends free behind the neck;

sliding supports at corresponding one side ends of the band arms and provided with openings for allowing a sliding passage of the other respective band arm passing through and generating a variable interspace between the band arms between the sliding supports for passage of a napkin followed by clamping of the napkin;

protrusions disposed at one side of the inner wall providing horizontal grooves for rendering the sliding motion of the band arms more easy;

extensions of the sliding supports with short arms extending parallel to the band arm toward the neighboring sliding support for allowing to fold back the napkin for producing a doubling of the napkin at the upper end;

a snap fastener matching the sliding supports to allow attachment of the band arm to the sliding support and for placing a desired emblem on the napkin support; and cross securing strips disposed near the free ends of the band arms.

* * * * *